US008957576B2

(12) United States Patent
Ahn

(10) Patent No.: US 8,957,576 B2
(45) Date of Patent: Feb. 17, 2015

(54) PIXEL AND ORGANIC LIGHT EMITTING DISPLAY USING THE SAME

(75) Inventor: Jung-Keun Ahn, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 589 days.

(21) Appl. No.: 13/176,451

(22) Filed: Jul. 5, 2011

(65) Prior Publication Data

US 2012/0161611 A1 Jun. 28, 2012

(30) Foreign Application Priority Data

Dec. 27, 2010 (KR) ..... 10-2010-0135327

(51) Int. Cl.
*H01J 1/62* (2006.01)
*G09G 3/32* (2006.01)

(52) U.S. Cl.
CPC ..... *G09G 3/3233* (2013.01)
USPC ..... 313/504

(58) Field of Classification Search
USPC ..... 313/500–509
See application file for complete search history.

(56) References Cited

FOREIGN PATENT DOCUMENTS

KR 10-2005-0090861 A 9/2005
KR 10-2010-0006106 A 1/2010

*Primary Examiner* — Anh Mai
*Assistant Examiner* — Brenitra M Lee
(74) *Attorney, Agent, or Firm* — Christie, Parker & Hale, LLP

(57) ABSTRACT

A pixel according to an embodiment includes: an organic light emitting diode (OLED); a first transistor coupled between a data line and a first node and configured to be turned on when a scan signal is supplied to a scan line; a third transistor coupled between a reference power source and a second node and configured to be concurrently turned on and off with the first transistor; a storage capacitor coupled between the first node and the second node; a second transistor coupled between a first power source and the OLED and having a gate electrode coupled to the first node; a fourth transistor coupled between the first power source and the second node and having a gate electrode coupled to a control line; and a fifth transistor coupled between the second transistor and the OLED and having a gate electrode coupled to an emission control line.

10 Claims, 2 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2010-0135327, filed on Dec. 27, 2010 in the Korean Intellectual Property Office, the entire content of which is incorporated herein by reference.

BACKGROUND

1. Field

The present invention relates to a pixel and an organic light emitting display using the same.

2. Description of the Related Art

Recently, various flat panel displays (FPDs) capable of having reduced weight and volume that are the disadvantages of cathode ray tubes (CRTs) have been developed. Types of FPDs include liquid crystal displays (LCDs), field emission displays (FEDs), plasma display panels (PDPs), and organic light emitting displays.

Among the FPDs, the organic light emitting displays display images using organic light emitting diodes (OLED) that generate light by re-combination of electrons and holes. The organic light emitting display has a high response speed and can be driven with low power consumption.

In general, pixels of the organic light emitting display charge voltages corresponding to differences between a first power source and data signals in storage capacitors, and supply currents corresponding to the charged voltages to organic light emitting diodes (OLED) to display an image (e.g., a predetermined image). Here, the first power source is a voltage supply for supplying currents to the pixels and a voltage drop of the first power source may be relatively large. Therefore, sufficient (or desired) voltages are not stored (or charged) in the storage capacitors due to the voltage drop of the first power source, so that an image may not be displayed with a desired brightness.

SUMMARY

Accordingly, aspects of embodiments of the present invention provide a pixel capable of displaying an image with a desired brightness regardless of the voltage drop of a first power source, and an organic light emitting display using the same.

In order to address the above issues, there is provided a pixel including: an organic light emitting diode (OLED); a first transistor coupled between a data line and a first node and configured to be turned on when a scan signal is supplied to a scan line; a third transistor coupled between a reference power source and a second node and configured to be concurrently turned on and off with the first transistor; a storage capacitor coupled between the first node and the second node; a second transistor coupled between a first power source and the OLED and having a gate electrode coupled to the first node; a fourth transistor coupled between the first power source and the second node and having a gate electrode coupled to a control line; and a fifth transistor coupled between the second transistor and the OLED and having a gate electrode coupled to an emission control line.

The fourth and fifth transistors may maintain a turn off state in a period where the first transistor is turned on.

The fifth transistor may maintain a turn off state for a longer time than the fourth transistor.

The reference power source may be set to have substantially the same voltage value as the first power source.

According to another embodiment of the present invention, an organic light emitting display includes: a scan driver for driving scan lines, control lines, and emission control lines; a data driver for driving data lines; and pixels at crossing regions of the scan lines and the data lines, wherein each of the pixels in an ith horizontal line, where i is a natural number, includes: an organic light emitting diode (OLED); a first transistor coupled between a data line and a first node and configured to be turned on when a scan signal is supplied to an ith scan line of the scan lines; a third transistor coupled between a reference power source and a second node and configured to be turned on when the scan signal is supplied to the ith scan line; a storage capacitor coupled between the first node and the second node; a second transistor coupled between a first power source and the OLED and having a gate electrode coupled to the first node; a fourth transistor coupled between the first power source and the second node and configured to be turned off when a control signal is supplied to an ith control line of the control lines; and a fifth transistor coupled between the second transistor and the OLED and configured to be turned off when an emission control signal is supplied to an ith emission control line of the emission control lines.

The scan driver may be configured to supply the control signal to the ith control line for a period of time that overlaps a period of time during which the scan signal is supplied to the ith scan line.

The control signal may be set to have a larger width than the scan signal.

The scan driver may be configured to supply the emission control signal to the ith emission control line for a period of time that overlaps a period of time during which the control signal is supplied to the ith control line.

The emission control signal may be set to have a larger width than the control signal.

The reference power source may be set to have substantially the same voltage value as the first power source.

In the pixel according to an embodiment of the present invention and the organic light emitting display using the same, an image with desired brightness may be displayed regardless of the voltage drop of the first power source.

BRIEF DESCRIPTION OF THE DRAWINGS

The accompanying drawings, together with the specification, illustrate exemplary embodiments of the present invention, and, together with the description, serve to explain principles of the present invention.

DETAILED DESCRIPTION

Figure 1:
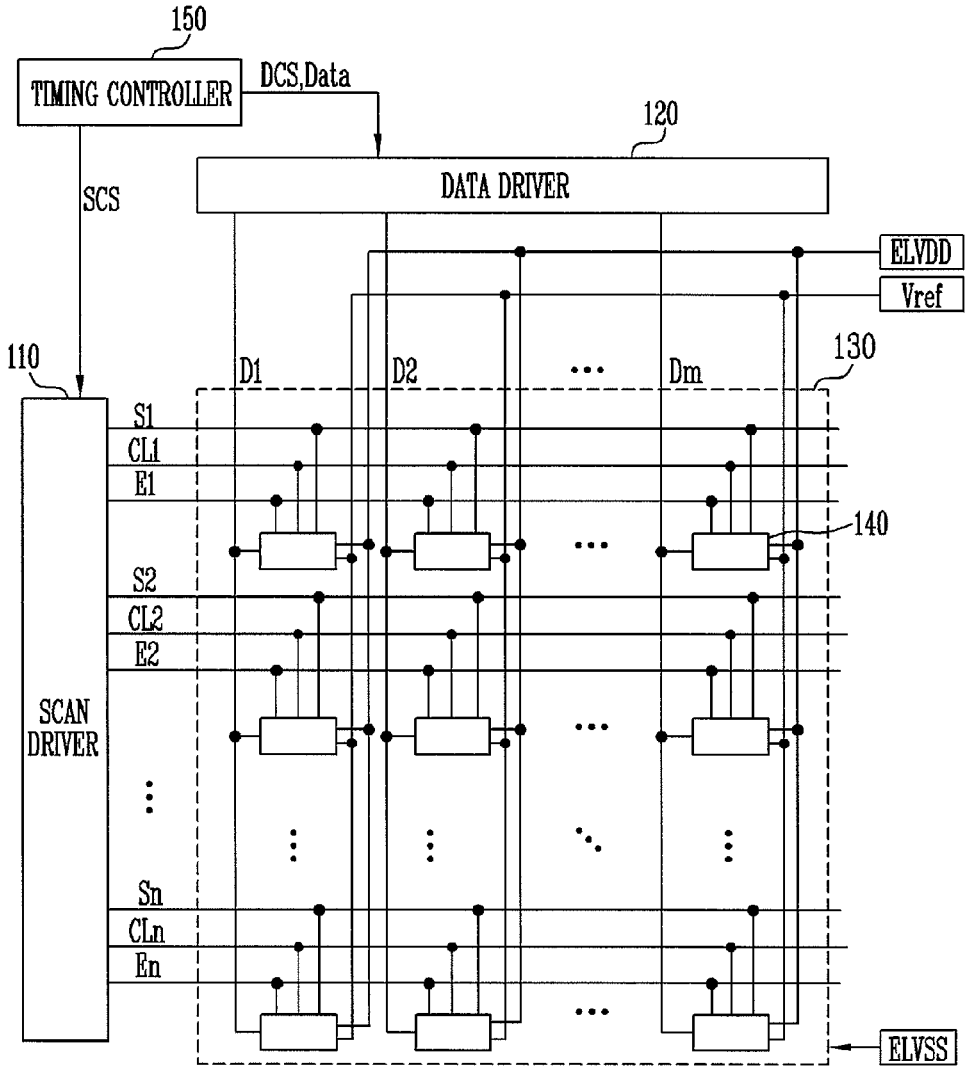
FIG. 1 is a view illustrating an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to a complete understanding of the invention are omitted for clarity. Also, like reference numerals refer to like elements throughout.

Hereinafter, exemplary embodiments of the present invention, by which those skilled in the art may perform the present invention, will be described in detail with reference to FIGS. 1 to 3.

FIG. 1 is a view illustrating an organic light emitting display according to an embodiment of the present invention.

Referring to FIG. 1, the organic light emitting display according to an embodiment of the present invention includes a display unit 130 including a plurality of pixels 140 coupled to scan lines S1 to Sn, emission control lines E1 to En, control lines CL1 to CLn, and data lines D1 to Dm, a scan driver 110 for driving the scan lines S1 to Sn, the emission control lines E1 to En, and the control lines CL1 to CLn, a data driver 120 for driving the data lines D1 to Dm, and a timing controller 150 for controlling the scan driver 110 and the data driver 120.

The display unit 130 includes the pixels 140 positioned at crossing regions of the scan lines S1 to Sn and the data lines D1 to Dm. The pixels 140 receive a first power source ELVDD, a second power source ELVSS, and a reference power source Vref from the outside. The pixels 140 that receive the reference power source Vref charge the voltages corresponding to the reference power source Vref and data signals in storage capacitors (shown in FIG. 2). The reference power source Vref can be set to have the same voltage value as the first power source ELVDD.

Figure 2:
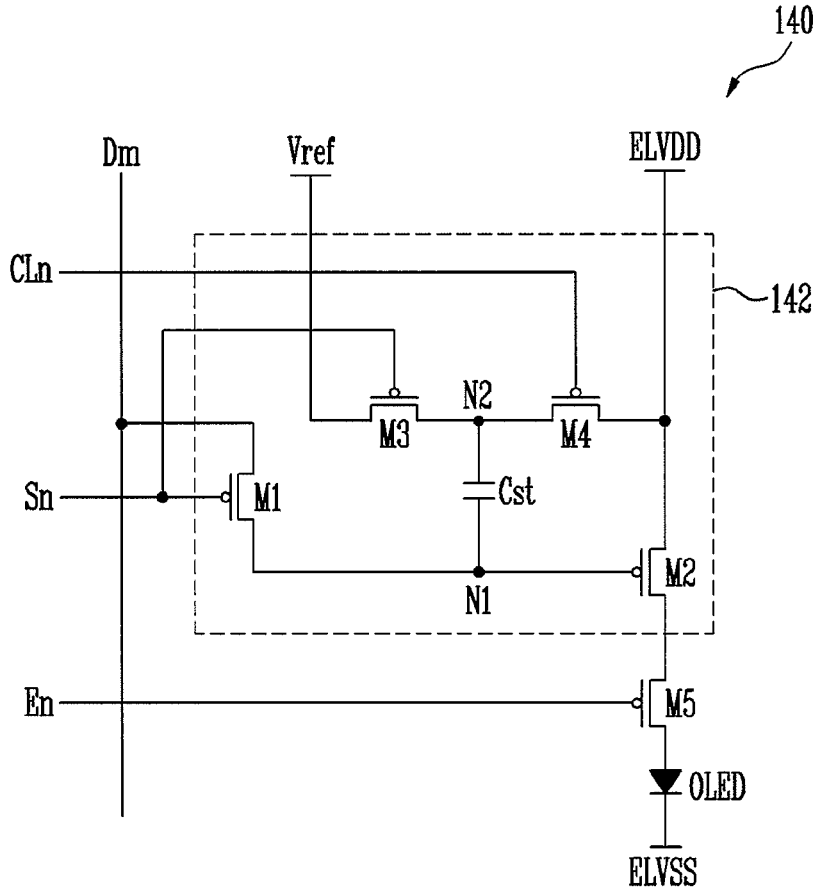
FIG. 2 is a circuit diagram illustrating a pixel according to an embodiment of the organic light emitting display of FIG. 1.

The pixels 140 that charge voltages (e.g., predetermined voltages) in the storage capacitors supply currents corresponding to the charged voltages from the first power source ELVDD to the second power source ELVSS via organic light emitting diodes (shown in FIG. 2). Then, light (e.g., light with a predetermined brightness) is generated by the OLEDs.

The timing controller 150 generates data driving control signals DCS and scan driving control signals SCS to correspond to the synchronizing signals supplied from the outside. The data driving control signals DCS generated by the timing controller 150 are supplied to the data driver 120 and the scan driving control signals SCS are supplied to the scan driver 110. Then, the timing controller supplies a data signal Data supplied from the outside to the data driver 120.

The scan driver 110 receives the scan driving control signals SCS. The scan driver 110 that receives the scan driving control signals SCS sequentially supplies scan signals (e.g., low level voltages) to the scan lines S1 to Sn and sequentially supplies emission control signals (e.g., high level voltages) to the emission control lines E1 to En. The scan driver 110 sequentially supplies control signals (e.g., high level voltages) to the control lines CL1 to CLn.

Figure 3:
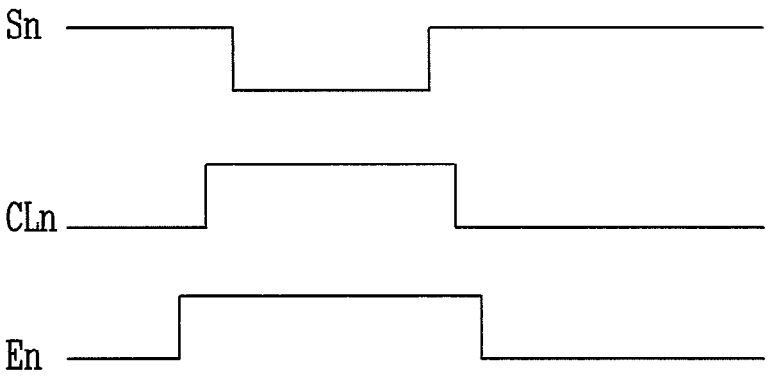
FIG. 3 is a waveform chart illustrating a method of driving the pixel of FIG. 2.

Here, as shown in FIG. 3, the control signal supplied to the ith (i is a natural number) control line CLi overlaps the scan signal supplied to the ith scan line Si and is set to have a larger width than the scan signal. The emission control signal supplied to the ith emission control line Ei overlaps the control signal supplied to the ith control line CLi and is set to have a larger width than the control signal.

The data driver 120 receives the data driving control signals DCS from the timing controller 150. The data driver 120 that receives the data driving control signals DCS generates data signals and the generated data signals are supplied to the data lines D1 to Dm.

FIG. 2 is a circuit diagram illustrating a pixel according to an embodiment of the organic light emitting display of FIG. 1. In FIG. 2, for the sake of convenience, a pixel coupled to the nth scan line Sn and the mth data line Dm will be illustrated.

Referring to FIG. 2, the pixel 140 according to an embodiment of the present invention includes an OLED and a pixel circuit 142 for supplying current to the OLED.

The OLED generates light (e.g., light with a predetermined brightness) to correspond to the current supplied from the pixel circuit 142. For example, the OLED generates red, green, or blue light (e.g., red, green, or blue light having a predetermined brightness) to correspond to the amount of current supplied from the pixel circuit 142.

The pixel circuit 142 charges the voltages corresponding to the reference power source Vref and the data signal, and supplies the currents corresponding to the charged voltages to the OLED. The pixel includes first to fifth transistors M1 to M5 and a storage capacitor Cst.

The first electrode of the first transistor M1 is coupled to the data line Dm and the second electrode of the first transistor M1 is coupled to a first node N1. The gate electrode of the first transistor M1 is coupled to the scan line Sn. The first transistor M1 is turned on when a scan signal is supplied to the scan line Sn, to electrically couple the data line Dm to the first node N1.

The first electrode of the second transistor M2 is coupled to the first power source ELVDD and the second electrode of the second transistor M2 is coupled to the first electrode of the fifth transistor M5. The gate electrode of the second transistor M2 is coupled to the first node N1. The second transistor M2 supplies the current corresponding to the voltage applied to the first node N1, that is, the voltage charged in the storage capacitor Cst, to the OLED.

The first electrode of the third transistor M3 is coupled to the reference power source Vref and the second electrode of the third transistor M3 is coupled to a second node N2. The gate electrode of the third transistor M3 is coupled to the scan line Sn. The third transistor M3 is turned on when the scan signal is supplied to the scan line Sn to supply the voltage of the reference power source Vref to the second node N2.

The first electrode of the fourth transistor M4 is coupled to the first power source ELVDD and the second electrode of the fourth transistor M4 is coupled to the second node N2. The gate electrode of the fourth transistor M4 is coupled to the control line CLn. The fourth transistor M4 is turned off when a control signal is supplied to the control line CLn and is turned on when the control signal is not supplied. Since the control signal is supplied to overlap the scan signal, the fourth transistor M4 is turned off in a period where voltage (e.g., a predetermined voltage) is charged in the storage capacitor Cst, and is turned on in the other periods.

The first electrode of the fifth transistor M5 is coupled to the second electrode of the second transistor M2 and the second electrode of the fifth transistor M5 is coupled to the anode electrode of the OLED. The gate electrode of the fifth transistor M5 is coupled to the emission control line En. The fifth transistor M5 is turned off when an emission control signal is supplied to the emission control line En and is turned on when the emission control signal is not supplied. Since the emission control signal is supplied to overlap the control signal, the fifth transistor M5 is turned off in a period where a voltage (e.g., a predetermined voltage) is charged in the storage capacitor Cst, and is turned on in the other periods.

The first power source ELVDD is coupled to the pixels 140 to supply a current (e.g., a predetermined current). As such, a voltage drop (e.g., a predetermined voltage drop) is generated that corresponds to the positions of the pixels 140. However, the reference power source Vref does not supply current to the pixels 140. Therefore, the pixels 140 are set to have the same voltage regardless of the positions of the pixels 140.

FIG. 3 is a waveform chart illustrating a method of driving the pixel of FIG. 2.

Referring to FIG. 3, the emission control signal is supplied to the emission control line En so that the fifth transistor M5 is turned off. When the fifth transistor M5 is turned off, the second transistor M2 and the OLED are electrically isolated from each other so that light is not generated by the OLED.

When the fifth transistor M5 is turned off, the control signal is supplied to the control line CLn so that the fourth transistor M4 is turned off. When the fourth transistor M4 is turned off, the second node N2 and the first power source ELVDD are electrically isolated from each other. Then, the scan signal is supplied to the scan line Sn so that the first transistor M1 and the third transistor M3 are turned on.

When the first transistor M1 is turned on, the data signal from the data line Dm is supplied to the first node N1. When the third transistor M3 is turned on, the voltage of the reference power source Vref is supplied to the second node N2. At this time, the storage capacitor Cst charges the voltage corresponding to a difference between the reference power source Vref and the data signal.

After the voltage is charged in the storage capacitor Cst, supply of the signals is stopped in the order of the scan signal, the control signal, and the emission control signal.

The supply of the scan signal to the scan line Sn is stopped so that the first transistor M1 and the third transistor M3 are turned off. When the first transistor M1 is turned off, the data line Dm and the first node N1 are electrically isolated from each other. When the third transistor M3 is turned off, the reference power source Vref and the second node N2 are electrically isolated from each other.

When the supply of the control signal to the control line CLn is stopped, the fourth transistor M4 is turned on. When the fourth transistor M4 is turned on, the voltage of the first power source ELVDD is supplied to the second node N2. Accordingly, the voltage of the second node N2 changes from the voltage of the reference power source Vref to the voltage of the first power source ELVDD. At this time, since the first node N1 is set in a floating state, the storage capacitor Cst maintains the voltage charged in a previous period. Additionally, when the first node N1 is set in the floating state, the voltage of the first node N1 changes to correspond to the amount of a change in the voltage of the second node N2. Therefore, the voltage drop of the first power source ELVDD may be compensated for.

In detail, the voltage of the second node N2 is reduced from the voltage (for example, 10V) of the reference power source Vref to the voltage of the first power source ELVDD, in order to reflect the voltage reduction in the first power source ELVDD. For example, when the voltage of the first power source ELVDD is about 9V in a first pixel, the voltage reduction amount of the second node N2 is about 1V. When the voltage of the first power source ELVDD is about 8V in a second pixel, the voltage reduction amount of the second node N2 is about 2V. Accordingly, the amount of voltage applied to the first node N1 of the first pixel is the voltage of the data signal reduced by about 1V, and the amount of voltage applied to the first node N1 of the second pixel is the voltage of the data signal reduced by about 2V. That is, according to an embodiment of the present invention, the voltage of the first node N1 is controlled to correspond to the voltage drop of the first power source ELVDD so that the voltage drop of the first power source ELVDD may be compensated for.

Additionally, according to an embodiment of the present invention, the voltage of the second node N2 changes from the predictable voltage Vref to the unpredictable voltage ELVDD. That is, according to an embodiment of the present invention, the voltage of the second node N2 is controlled from the predictable voltage of the reference power source Vref to the voltage of the first power source ELVDD. When the voltage of the second node N2 changes from an unpredictable voltage (for example, the voltage of the data signal) to the unpredictable voltage ELVDD, the voltage drop of the first power source ELVDD is not correctly compensated for.

When the supply of the emission control signal to the emission control line En is stopped, the fifth transistor M5 is turned on. When the fifth transistor M5 is turned on, the second transistor M2 and the OLED are electrically coupled to each other. Then, the OLED generates light (e.g., light with a predetermined brightness) to correspond to the amount of current supplied from the second transistor M2.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode (OLED);

a first transistor coupled between a data line and a first node and configured to be turned on when a scan signal is supplied to a scan line;

a third transistor coupled between a reference power source and a second node and configured to be concurrently turned on and off with the first transistor;

a storage capacitor coupled between the first node and the second node;

a second transistor coupled between a first power source and the OLED and having a gate electrode coupled to the first node;

a fourth transistor coupled between the first power source and the second node and having a gate electrode coupled to a control line; and a fifth transistor coupled between the second transistor and the OLED and having a gate electrode coupled to an emission control line, wherein a gate electrode of the first transistor and a gate electrode of the third transistor are coupled to the scan line.

2. The pixel as claimed in claim 1, wherein the fourth and fifth transistors maintain a turn off state in a period where the first transistor is turned on.

3. The pixel as claimed in claim 2, wherein the fifth transistor maintains a turn off state for a longer time than the fourth transistor.

4. The pixel as claimed in claim 1, wherein the reference power source is set to have substantially the same voltage value as the first power source.

5. An organic light emitting display comprising:

a scan driver for driving scan lines, control lines, and emission control lines;

a data driver for driving data lines; and pixels at crossing regions of the scan lines and the data lines, wherein each of the pixels in an ith horizontal line, where i is a natural number, comprises:

an organic light emitting diode (OLED);

a first transistor coupled between a data line and a first node and configured to be turned on when a scan signal is supplied to an ith scan line of the scan lines;

a third transistor coupled between a reference power source and a second node and configured to be turned on when the scan signal is supplied to the ith scan line;

a storage capacitor coupled between the first node and the second node;

a second transistor coupled between a first power source and the OLED and having a gate electrode coupled to the first node;

a fourth transistor coupled between the first power source and the second node and configured to be turned off when a control signal is supplied to an ith control line of the control lines; and a fifth transistor coupled between the second transistor and the OLED and configured to be turned off when an emission control signal is supplied to an ith emission control line of the emission control lines, wherein a gate electrode of the first transistor and a gate electrode of the third transistor are coupled to the scan line.

6. The organic light emitting display as claimed in claim 5, wherein the scan driver is configured to supply the control signal to the ith control line for a period of time that overlaps a period of time during which the scan signal is supplied to the ith scan line.

7. The organic light emitting display as claimed in claim 5, wherein the control signal is set to have a larger width than the scan signal.

8. The organic light emitting display as claimed in claim 5, wherein the scan driver is configured to supply the emission control signal to the ith emission control line for a period of time that overlaps a period of time during which the control signal is supplied to the ith control line.

9. The organic light emitting display as claimed in claim 8, wherein the emission control signal is set to have a larger width than the control signal.

10. The organic light emitting display as claimed in claim 5, wherein the reference power source is set to have substantially the same voltage value as the first power source.

* * * * *